US011393326B2

(12) United States Patent
Arsinow et al.

(10) Patent No.: US 11,393,326 B2
(45) Date of Patent: Jul. 19, 2022

(54) EMERGENCY RESPONSE DRILLS

(71) Applicant: Rauland-Borg Corporation, Mount Prospect, IL (US)

(72) Inventors: Alan Arsinow, Des Plaines, IL (US); Peter Holtermann, Wilmette, IL (US); Stacie Dinse, Des Plaines, IL (US)

(73) Assignee: Rauland-Borg Corporation, Mount Prospect, IL (US)

( * ) Notice: Subject to any disclaimer, the term of this patent is extended or adjusted under 35 U.S.C. 154(b) by 0 days.

(21) Appl. No.: 16/569,192

(22) Filed: Sep. 12, 2019

(65) Prior Publication Data

US 2021/0082274 A1 Mar. 18, 2021

(51) Int. Cl.

| | |
|---|---|
| ***G08B 27/00*** | (2006.01) |
| ***G08B 3/10*** | (2006.01) |
| ***G08B 5/36*** | (2006.01) |
| ***G08B 21/02*** | (2006.01) |

(52) U.S. Cl.

CPC ..... *G08B 27/00* (2013.01); *G08B 3/1033* (2013.01); *G08B 5/36* (2013.01); *G08B 21/02* (2013.01)

(58) Field of Classification Search

CPC ..... G08B 27/00; G08B 3/1033; G08B 5/36; G08B 21/02

See application file for complete search history.

(56) References Cited

U.S. PATENT DOCUMENTS

| | | | |
|---|---|---|---|
| 5,838,223 A | 11/1998 | Gallant et al. | |
| 6,097,288 A | 8/2000 | Koeppe, Jr. | |
| D527,011 S | 8/2006 | Bixler | |
| 7,292,135 B2 | 11/2007 | Bixler et al. | |
| 7,333,002 B2 | 2/2008 | Bixler et al. | |
| 7,526,529 B2 | 4/2009 | Unluturk et al. | |
| 8,032,403 B2 | 10/2011 | Gremont et al. | |
| 8,806,473 B2 | 8/2014 | Birtwhistle et al. | |
| 9,299,238 B1 * | 3/2016 | Ahmad | A61B 5/083 |

(Continued)

FOREIGN PATENT DOCUMENTS

WO WO 2019/142370 A1 7/2019

OTHER PUBLICATIONS

Guo et al. "A ZigBee Network Application in Emergency Exit Guiding," *2010 International Computer Symposium* (ICS2010), 91-94 (2010).

(Continued)

*Primary Examiner* — Steven S Kelley

(74) *Attorney, Agent, or Firm* — Leydig, Voit & Mayer, Ltd.

(57) ABSTRACT

A school communication system includes: a district server configured to manage at least one communication system located within a district location managed by the district server; a district network configured to communicatively couple the at least one communication system and the district server; and the at least one communication system. The at least one communication system comprises: a network switch configured to integrate communication equipment associated with the district location; and campus controller. The campus controller is configured to: receive an emergency drill configuration from the district server; receive a signal to begin an emergency drill; perform one or more actions in the emergency drill via the network switch; and report that the drill was initiated.

20 Claims, 3 Drawing Sheets

(56) References Cited

U.S. PATENT DOCUMENTS

| | | | | |
|---|---|---|---|---|
| 9,489,825 | B1 * | 11/2016 | McDonnell | G08B 27/006 |
| 10,430,746 | B2 * | 10/2019 | Bowles | G07C 9/28 |
| 2002/0138328 | A1 | 9/2002 | Arning et al. | |
| 2003/0074222 | A1 | 4/2003 | Rosow et al. | |
| 2004/0145481 | A1 | 7/2004 | Dilbeck et al. | |
| 2005/0075902 | A1 | 4/2005 | Wager et al. | |
| 2006/0049936 | A1 | 3/2006 | Collins et al. | |
| 2006/0111939 | A1 | 5/2006 | Bixler et al. | |
| 2006/0112187 | A1 | 5/2006 | Unluturk et al. | |
| 2006/0267740 | A1 | 11/2006 | Bixler et al. | |
| 2007/0192174 | A1 * | 8/2007 | Bischoff | G08B 21/0423 340/573.1 |
| 2007/0210910 | A1 * | 9/2007 | Norstrom | G08B 27/001 340/506 |
| 2007/0288285 | A1 | 12/2007 | Nilsson | |
| 2009/0212925 | A1 | 8/2009 | Schuman, Sr. et al. | |
| 2009/0313659 | A1 | 12/2009 | Samuels | |
| 2010/0169150 | A1 | 7/2010 | Gremont et al. | |
| 2010/0191543 | A1 | 7/2010 | Schuman | |
| 2010/0217618 | A1 | 8/2010 | Piccirillo et al. | |
| 2010/0305973 | A1 | 12/2010 | McLaren et al. | |
| 2011/0007883 | A1 | 1/2011 | Bingham et al. | |
| 2011/0112877 | A1 | 5/2011 | Govind et al. | |
| 2011/0208541 | A1 | 8/2011 | Wilson et al. | |
| 2011/0246220 | A1 | 10/2011 | Albert | |
| 2012/0028589 | A1 | 2/2012 | Fan et al. | |
| 2012/0329420 | A1 | 12/2012 | Zotti et al. | |
| 2013/0264074 | A1 * | 10/2013 | Lewis | A62C 37/36 169/46 |
| 2013/0323699 | A1 | 12/2013 | Edwards et al. | |
| 2014/0024333 | A1 | 1/2014 | Stadtlander | |
| 2014/0132393 | A1 | 5/2014 | Evans | |
| 2014/0244819 | A1 | 8/2014 | Patrick et al. | |
| 2014/0327519 | A1 | 11/2014 | Carroll et al. | |
| 2014/0365390 | A1 * | 12/2014 | Braun | H04W 4/023 705/325 |
| 2014/0379357 | A1 | 12/2014 | Srivathsa et al. | |
| 2015/0109442 | A1 | 4/2015 | Derenne et al. | |
| 2015/0339407 | A1 | 11/2015 | Gallo et al. | |
| 2016/0165369 | A1 | 6/2016 | Perkins et al. | |
| 2017/0039823 | A1 | 2/2017 | Srivathsa et al. | |
| 2017/0257400 | A1 | 9/2017 | Peters | |
| 2018/0162413 | A1 | 6/2018 | Theodosiou | |
| 2018/0330813 | A1 | 11/2018 | Garber et al. | |
| 2019/0088097 | A1 | 3/2019 | Jacobs | |
| 2019/0295207 | A1 | 9/2019 | Day et al. | |
| 2020/0098230 | A1 * | 3/2020 | Dwight | A62C 99/0081 |

OTHER PUBLICATIONS

European Patent Office, International Search Report and the Written Opinion in International Application No. PCT/US2020/053706 (dated Jan. 18, 2021).

* cited by examiner

EMERGENCY RESPONSE DRILLS

FIELD

Embodiments of this disclosure generally relate to communication systems, and, in certain embodiments, to a communication system integration and operation.

BACKGROUND

Communication systems facilitate communication of status and events within some defined area. Communication systems also allow organizations and facilities to coordinate activities within said facilities. For instance, one particular type of communication system is an intercom system within a school campus. The school intercom system communicates status and events within a school campus to students, teachers, other staff members, visitors, and so on. In this manner, those within the school can maintain a daily schedule for the school and be able to receive specific information via the announcements. Typically, the intercom system allows for audio communication, which can be effective in alerting individuals within the school of status information, but its effectiveness can be beholden to the performance of its user. For example, effectively communicating important information during stages of a practice drill or an emergency is dependent on the specific user using the intercom system.

SUMMARY

An embodiment of the disclosure provides a district communication system, including: a district server configured to manage a campus communication system located within a district location managed by the district server; and a district network configured to communicatively couple the campus communication system and the district server; wherein the campus communication system comprises: a network switch configured to integrate communication equipment associated with the campus communication system; and a campus controller configured to: receive an emergency drill configuration from the district server; receive a signal to begin an emergency drill defined by the emergency drill configuration; control the communication equipment to perform one or more actions defined in the emergency drill configuration via signalizing through the network switch to the communication equipment; and record that the emergency drill is performed.

Another embodiment of the disclosure provides a method for performing an emergency drill at a campus communication system communicatively coupled to a district server via a district network, wherein the campus communication system is managed by the district server to perform the method comprising: receiving an emergency drill configuration from a district server; receiving a signal to begin an emergency drill, wherein the emergency drill comprises one or more actions to be performed by the campus communication system, and the one or more actions are defined in the emergency drill configuration; performing the one or more actions in the emergency drill by the campus communication system; and recording that the emergency drill is performed.

Yet another embodiment of the disclosure provides a campus communication system communicatively associated with a campus and coupled to a district sever through a district network, the district server controls operation of the campus communication system via signaling through the district network, the campus communication system comprising: a network switch configured to integrate communication equipment associated with the campus communication system; and a campus controller configured to: receive an emergency drill configuration from the district server; receive a signal to begin an emergency drill defined by the emergency drill configuration; control the communication equipment to perform one or more actions defined in the emergency drill configuration via signalizing through the network switch to the communication equipment; and record that the emergency drill is performed.

BRIEF DESCRIPTION OF THE DRAWINGS

The accompanying drawings incorporated in and forming a part of the specification illustrate several aspects of the present invention and, together with the description, serve to explain the principles of the disclosure.

Figure 1:
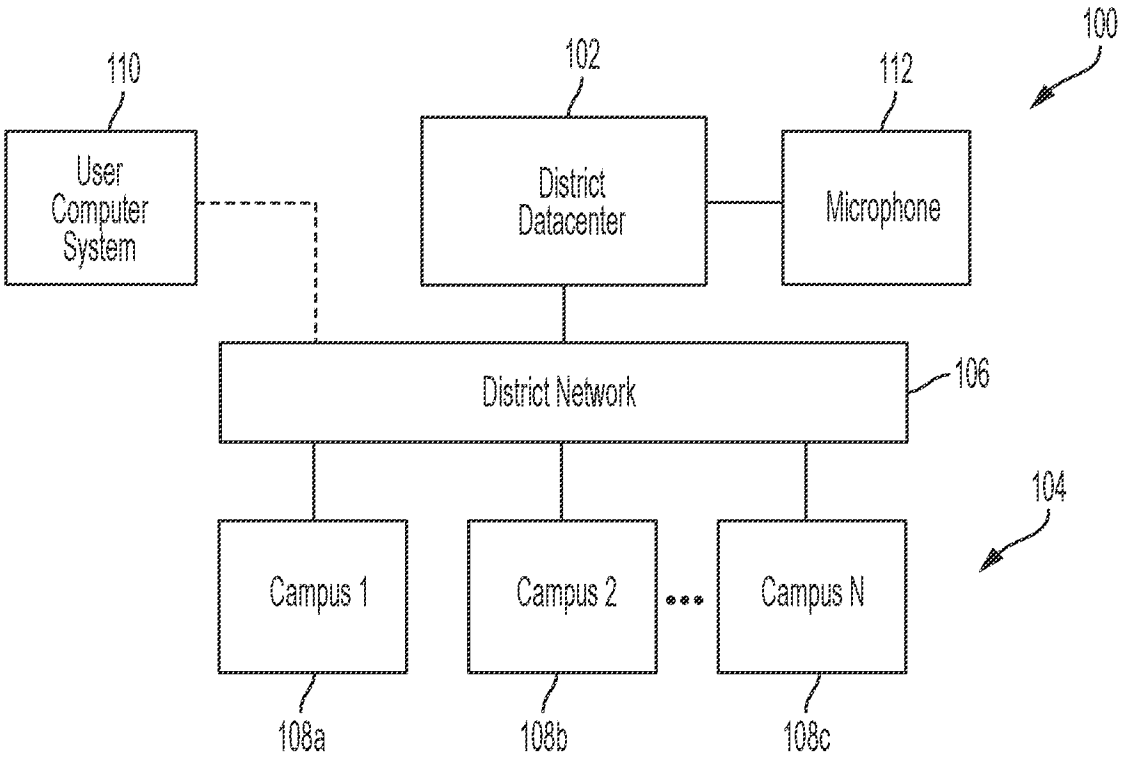
FIG. 1 is a block diagram of a communication system integrated at a school district level, according to an exemplary embodiment.

While the disclosure will be described in connection with certain preferred embodiments, there is no intent to limit it to those embodiments. On the contrary, the intent is to cover all alternatives, modifications and equivalents as included within the spirit and scope of the disclosure.

DETAILED DESCRIPTION

Embodiments of the disclosure described below are directed to communication systems that facilitate schools to practice emergency situations and report on successes or failures of such practices. Examples of emergencies include earthquakes, tornados, active shooter situations, and so on. For instance, embodiments of the disclosure describe communication systems with critical functionality such as providing detailed steps and procedures to follow during a practice emergency situation.

The embodiments of the communication system described below are directed to improvements on a manual intercom/walky-talky system typically found within a school environment. However, the communication system that is the subject of the disclosure contained herein is not intended to be limited to use within a school environment. Indeed, embodiments of the communication system, may be utilized in any environment that includes multiple rooms, spaces and/or hallways, such as found in office buildings, military bases or other similar structures. As such, the disclosure describing the functionality of the communication system described below are not limited strictly to the school environment. Rather, the description is provided in relation to the school environment for ease of description, and could be extrapolated to other environments, as would be understood by one of skill in the art in view of the disclosure contained herein.

Embodiments of the disclosure provide an emergency drills system that conducts emergency drill practice in a structured organized way. Embodiments of the disclosure provide a repeatable structured way to initiate and conduct a drill, instead of manually alerting a school for emergency drills. Embodiments of the disclosure provide an ability to exclude individual steps from the practice emergency drill that would normally be performed during a real emergency. For example, during the practice drill, reaching out to law enforcement is not necessary since an emergency is not present. Therefore, the emergency drills system can exclude steps such as dialing 911 to reach law enforcement during the practice drill. In some embodiments, the emergency drills system also creates or generates reports for a performed practice drill, providing proof that the drill was performed and providing statistics surrounding the drill, thus allowing a school system to demonstrate compliance.

With respect to the school environment, individual schools may be arranged into school districts based on a geographic proximity between each school. Further, each school may include communication equipment that allows for communication of a school schedule and for communication between locations within the school and the district. This communication equipment generally includes devices such as classroom speakers for direct communication between a classroom and a front office of the school. Typically, the communication equipment within each individual school is interconnected district wide. Emergency drills that schools may practice include gas leaks, bomb scare, shelter in place, HAZMAT, tornado, active shooter, earthquakes, and so on.

FIG. 1 illustrates a district wide interconnected and centrally administered school district communication system 100. As illustrated in FIG. 1, a plurality of school campuses 104, each with an individual school communication system, are organized into the school district communication system 100. As illustrated, the plurality of school campuses 104 are interconnected through a district network 106, which in turn interfaces the plurality of school campuses 104 with a district datacenter 102. The district datacenter 102 includes a server or servers each with an associated processor or processors running a networked application controlling a communication system within each of the plurality of school campuses 104. The networked application provides school district administrators with the ability to control all communication among the plurality of school campuses 104. This control is provided through a user interface, which allows control over bell schedules, announcements and other calendar management tools along with enabling drills and emergency notifications for lockdown, lock out and evacuation events. The district datacenter 102 configures and stores emergency drills for each school campus 104 and also stores reports generated from the emergency drills at each school campus 104. School administrators access this user interface via a user computer system 110, which is communicatively coupled to the district network 106.

In a particular embodiment, the user interface may be a web-based user interface, and the user computer system 110 can be any computer system that is capable of communicating with the district network 106 over the web-based user interface. For instance, the computer system 110 may take a variety of forms such as a mobile device, tablet device, laptop computer or any device capable of communicating with the web-based user interface.

Further, access to the web-based user interface from the user computer system 110 is granted based on an administrator's or user's login credentials. Any time a user accesses the web-based user interface, login credentials will be required before any functionality is provided. The login credentials not only provide access to the web-based user interface, but they also provide a level of access to the communication systems at the plurality of school campuses 104. For instance, in certain embodiments, the plurality of school campuses 104 may include individual school campuses 1-N, 108*a*, 108*b* and 108*c*, and the individual user may only be authorized to control the communication system at a single campus such as school campus 1 108*a*. Therefore, upon entering the user login credentials, the district datacenter 102 administrating the web-based user interface will look up the user's level of access and provide control only according to that access via the web-based user interface.

In certain embodiments, the district datacenter 102 further includes an integrated computer terminal that hosts a microphone 112. The microphone 112 is configured to allow a user to provide audio to the microphone 112, which can be streamed to any communication system at any campus 108*a*, 108*b* or 108*c* within the district. As an aside, each individual school communication system (see FIG. 2) can also include an integrated computer terminal that hosts a microphone client into which a microphone can be integrated such that an audio signal from the microphone can be broadcast over the individual school communication system. Emergency drills can be initiated at either the district level (e.g., via the district datacenter 102) or at the school level (e.g., via any of the plurality of school campuses 104).

Figure 2:
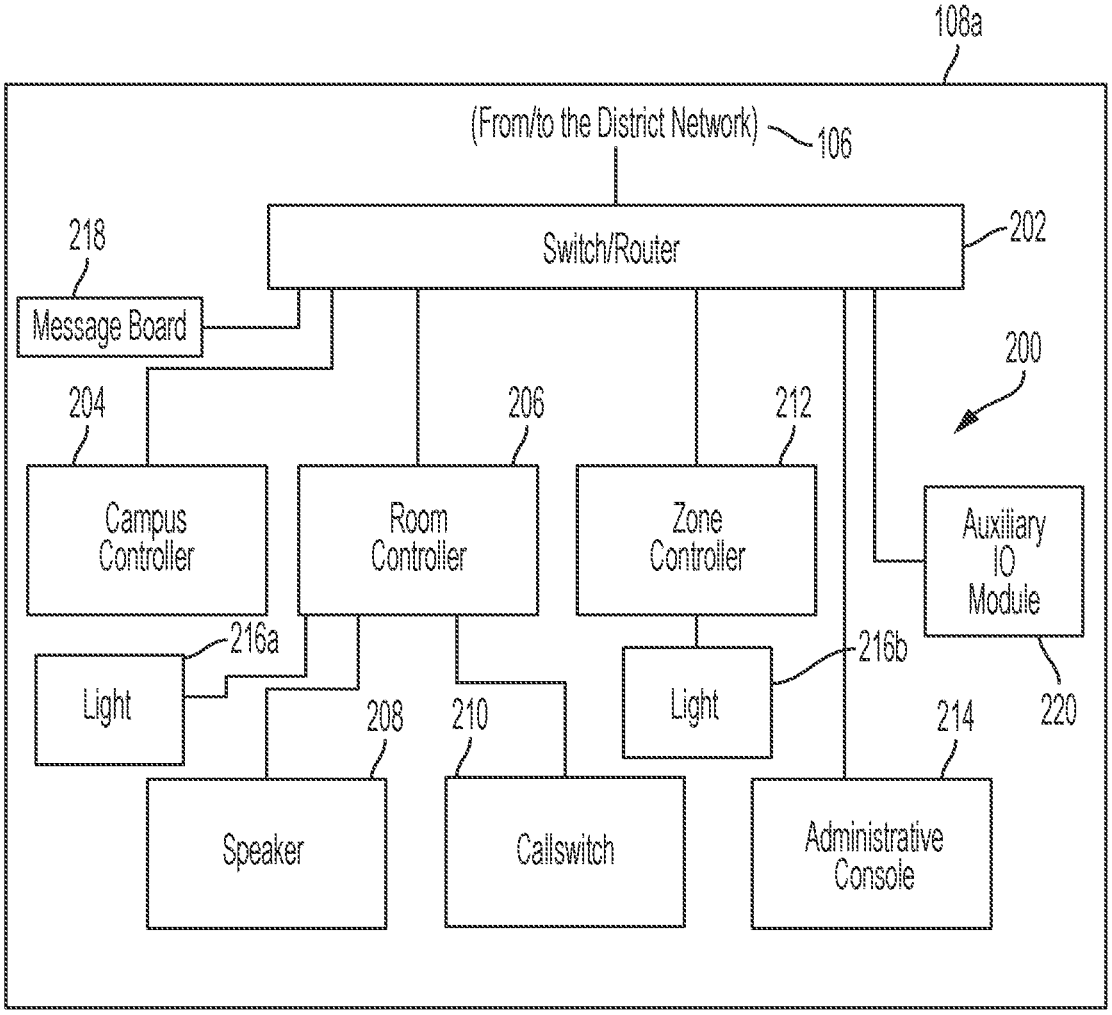
FIG. 2 is a block diagram of components of the communication system of FIG. 1, at the individual school level, according to an exemplary embodiment.

FIG. 2 illustrates the components of the school communication system 200 for individual school campus 108*a* (individual school campuses 108*b* and 108*c* may include school communication systems similar to school communication system 200). The school communication system 200 includes a switch/router 202, which provides a shared network connection for the various components of the school communication system 200 to the district network 106 (see FIG. 1). The various components of the school communication system 200 are distributed throughout a plurality of zones, which define physical spaces within the school campus 108*a*. In this regard, each zone has zone specific communication equipment associated with the district location/school campus 108*a*.

Components of the school communication system 200 may include a campus controller 204, a room or classroom controller 206, a zone controller 212, an administrative console 214, status indicator lights 216*a* and 216*b*, a message board 218, and an Auxiliary Input/Output (Aux IO) module 220. The campus controller 204 is an embedded interface for all of the campus devices located at the campus 108*a* to the district datacenter 102 (see FIG. 1). In this regard, the campus controller 204 functions to provide the interface for the classroom controller 206, the zone controller 212 and the administrative console 214 to the district datacenter 102. The campus controller 204 functions as a Session Initiation Protocol (SIP) Gateway, including processors and memory devices that enable the campus controller 204 to provide communication to/with various communication equipment, or, in other words, the campus communication equipment, including the classroom controller 206, the zone controller 212 and the administrative console 214. Communication equipment in general includes the call switch 210, the speaker 208, lights 216*a* and 216*b*, microphones (not shown), the administrative console 214, and controllers associated with each of these devices. The campus controller 204, in some embodiments, can also control relays on the Aux IO module 220 within the campus 108*a*. Relays on the Aux IO module 220 can be used, e.g., to disable doors and elevators. In this regard, the campus controller 204 functions to provide full paging, pre-recorded audio, live audio, intercom audio, and other control signals to any single campus device or combination of campus devices located within any number of zones throughout the campus 108*a*. Typically, the campus controller 204 interprets instructions received from the district datacenter 102 (see FIG. 1) by parsing those instructions to determine embedded communication events. The campus controller 204 then optionally stores/archives those instructions with an associated memory (not illustrated) and transmits the instructions in the form of a control signal to various campus devices such as those shown in communication system 200 and discussed above.

The school communication system 200 further includes the classroom controller 206 associated with each classroom of the school at campus 108*a*. In certain embodiments, each classroom can be considered a separate zone within the campus 108*a*. The classroom controller 206 communicates via IP-based signals and interfaces with the campus controller 204 through the switch/router 202 such that it sends/receives data to/from the campus controller 204. In this manner, the classroom controller 206 functions as an IP room module. The classroom controller 206 interfaces with a speaker 208, an in-room strobe or alert light (not illustrated), one or more switches or buttons such as a check-in or call switch 210, and a status indicator light 216*a* over a digital interface.

In certain embodiments, the speaker 208 interfaces with the classroom controller 206 through a bi-directional amplifier (not illustrated) which allows for the speaker module 208 to function as both a speaker and a microphone for the classroom controller 206. Typically, communication will be between the classroom controller 206 and the administrative console 214 or an external phone system and is controlled by the campus controller 204. The call switch 210 allows for personnel within the classroom containing the classroom controller 206 to call into the administrative console 214 or perform a check-in during an emergency situation. The classroom controller 206 can also trigger a visual indicator such as an in room strobe light or alert light upon receiving a command to do so from the campus controller 204. The classroom controller 206 can further trigger a visual indicator external to the classroom from the status indicator light 216*a* upon receiving a command to do so from the campus controller 204.

School communication system 200 further includes the zone controller 212, which functions in a similar manner to the classroom controller 206. Typically, a school will include a plurality of zones, other than classrooms, which comprise various locations throughout the school and campus in general. Typically, each non-classroom zone within the school will include at least one zone controller 212. The zone controller 212 decodes IP-based signals from the campus controller 204 into signals for controlling a status light indicator 216*b*. The zone controller 212 communicates these control signals to the status indicator light 216*b* over a digital interface. The school communication system 200 further includes the administrative console 214, which, in certain embodiments, provides a single point of access to the school communication system 200. In this regard, the administrative console 214 is equipped with various interfaces, speakers and microphones for communication within the school communication system 200. The administrative console 214 can initiate classroom intercom discussion over the classroom controller 206, perform zone or system-wide pages and receive visual alerts from classroom communications over a display associated with the administrative console 214. In certain embodiments, the administrative console 214 can also perform pre-programmed sequences for the school communication system 200, such as initiating an emergency sequence.

As mentioned above, the administrative console 214 includes an associated display. In certain embodiments, during an emergency event, the display can be configured to function as a centralized emergency console or in other words an emergency display console that can display check-in information for each zone or classroom within the school campus 108*a* (see FIG. 1). Check-in information indicates that a classroom has checked in by pressing the call switch 210 during the emergency event and thereby indicates that the particular classroom associated with that call switch 210 is not in an immediate emergency. In this regard, first responders to an emergency situation will have a single point where immediate status of the various classrooms and zones within the school campus 108*a*.

In an embodiment, the administrative console 214 can also aggregate call switch 210 signals, received via the campus controller 204, during an emergency drill which can be interpreted as students complying with instructions provided during the drill. The call switch 210 signal interpretation is dependent on the type of drill. For example, in an active shooter drill, the call switch 210 can be used to alert a location of a potential active shooter. In an emergency drill that requires moving students to designated locations, e.g., tornado safe locations, call switch 210 signals can be used to confirm classrooms that are evacuated. That way, the campus controller 204 can keep track of time elapsed between alerting students of the emergency drill and when a classroom is evacuated. The administrative console 214 can display information about the time elapsed determined by the campus controller 204. As an aside, an administrative console 214 is not required to be the centralized emergency drills console.

The campus controller 204 can receive emergency drill configurations from the district level via the district network 106. This setup allows a uniform standard for emergency drills across each campus in the plurality of campuses 104. This setup also allows for uniformity in messaging so that audio messages used during emergency drills can be updated at the district level and propagated to each campus in the plurality of campuses 104. After each emergency drill, the campus controller 204 can generate a report to be stored at the district level via the district network 106.

In an embodiment, an emergency drill configuration is different from an emergency based on steps being omitted. For example, Table 1 provides steps performed during an emergency. The steps performed during an emergency are performed according to the Order number. Steps identified with an "X" under Drill are performed in both emergencies and emergency drills while the other steps are performed only during an emergency.

TABLE 1

| Order | Action | Attachment | Location | Name | Drill |
|---|---|---|---|---|---|
| 1 | Play Audio/To | IntruderLockdown | All Page | Lockdown Message | X |
| 2 | Relay Action | | Aux Rly1 | Relay 1 On | |
| 3 | Delay | | | Delay 1 sec | X |
| 4 | Relay Action | | Aux Rly1 | Relay 1 Off | |
| 5 | Play Audio/To | Mini Chime | All Page | Chime 60s to All | X |

From Table 1, the district level can modify configurations of emergency drills by adding one or more steps, removing one or more steps, marking a step as being a step performed under Drill, or unmarking a step as being performed under Drill. For each emergency drill, the district datacenter 102 can generate a report whether the drill was successfully performed.

With respect to the emergency situation discussed above, Table 1 below illustrates a particular embodiment showing a relation between events that may take place during a lockdown sequence and their associated lighting and audio actions. In certain embodiments, the following lockdown sequence may be initiated or terminated from a designated pushbutton, computer, administrative console or SIP telephone. A user computer system 110 (see FIG. 1) can be used to modify and tailor emergency drill configurations received from the district level.

Table 2 provides examples of actions and parameters for each action that can be set according to some embodiments of the disclosure. Example actions include playing a preconfigured audio message, sending preconfigured email messages, turning relays ON and OFF, toggling swings, including time delays, controlling status lights, displaying messages on message boards, and making prerecorded telephone calls.

TABLE 2

| Action | Parameters and Uses |
|---|---|
| Play preconfigured Audio message or Tones to selected rooms. | Order - displays sequential order number of this event<br>Attachment - Select an audio file attachment<br>Location - Select one or more coverages, zones or rooms within the school<br>Duration - Number of seconds to play the selected attachment<br>Name - Provide a description of this event |
| Send preconfigured email messages to selected email addresses | Order - displays sequential order number of this event<br>Attachment - Select an email file attachment<br>Name - Provide a description of this event |
| Relay Action - Turns on or off selected relays | Order - displays sequential order number of this event<br>Relay Selection - select one or more individual relays<br>Relay Action ON - relay turned on until another event turns the relay off<br>Relay Action OFF - relay turned off until another event turns the relay on<br>Relay Action Short Pulse ON - relay turned on for a pre-determined ("short") duration<br>Relay Action Long Pulse ON - relay turned on for a pre-determined ("long") duration<br>Relay Action Pulse ON - pulses the relay on for specified number of seconds |
| Configurable Time Delay between Successive Steps (actions) | Order - displays sequential order number of this event<br>Duration - Number of seconds to delay<br>Name - Provide a description of this event |
| Status Light Controls - Room Attributes | Order - displays sequential order number of this event<br>Location - Select one or more coverages, zones or rooms within the school<br>Attribute - Select any currently configured room attribute for the school<br>Attribute Action - Select from ON or OFF<br>Name - Provide a description of this event |
| Notify SIP Phone (send preconfigured message to PXB extensions) | Order - displays sequential order number of this event<br>Attachment - Select an audio file attachment<br>SIP phone - Select SIP extension<br>Name - Provide a description of this event |
| Play predefined text message to Message Boards | Order - displays sequential order number of this event<br>Message action: Display by Duration, Iteration, Forever, or Idle<br>Attachment - Select a text message file attachment<br>Location - Select one or more coverages or zones within the school<br>Duration - Number of seconds to display the selected attachment |

In Table 2, drill action configuration can be read from a user computer system 110 (see FIG. 1). In an embodiment, the user computer system 110 provides individual campuses ability to add actions specific to their campus. That way, campuses can tailor the district's mandated emergency drills to their specific needs. For example, a campus can broadcast an evacuation message to direct students to specific safe areas of the campus, such as a library, a basketball gym or other such spaces.

In Table 2, for example, the campus controller 204 can direct the speaker 208 to play a preconfigured audio message. In an embodiment, the audio message can be received from the district level via the district network 106. In some embodiments, the audio message is retrieved from storage accessible to the campus controller 204. The campus controller 204 determines where to play the audio based on location parameters within the emergency drill configuration. For each action, since parameters can be set to custom values, a name parameter can be used to identify different actions.

In an embodiment, the campus controller 204 can send preconfigured email messages to certain email addresses. In an emergency, emails may be sent to parents informing them of the emergency; however, during a drill, a school campus may likely not send email to parents just like they would not alert emergency services. In the practice emergency drill scenario, the campus controller 204 can remove parents from the list and alert administrators, staff members, or district level administrators that a certain drill was performed or is underway.

In an embodiment, the campus controller 204 can turn relays ON or OFF on aux IO modules, such as aux IO module 220. These relays can be used to control various mechanical switches such as door locks and other such devices. For instance, during a campus lock down, the aux IO 220 may be utilized to actuate a door lock to lock down a portion of the campus 108*a* (see FIG. 1).

In an embodiment, the campus controller 204 can include delays just like "Delay" shown in Table 1. This allows a smooth transition from one action to another and gives the emergency drill system a way to control when one action follows another. When building a drill event, a user can add a delay to make sure one event occurs before another.

In an embodiment, the campus controller 204 can control status lights during emergency drills at different locations within the campus. The status light can be set to indicate what type of emergency drill is currently executing.

In an embodiment, the campus controller 204 can send a preconfigured voice message to private branch exchange (PXB) extensions so that it can reach telephone lines. In this manner, a voice message can be communicated to an outside telephone device. For instance, during an emergency, the drill could function to send a voice message to one or more telephones updating the recipient of the voice message about the emergency.

In an embodiment, the campus controller 204 can control message boards during emergency drills at different locations within the campus. The message boards can be set to indicate a type of emergency drill currently executing. Alternatively, the message board can indicate a status of the emergency or any other relevant type of message useful during execution of the emergency drill.

Figure 3:
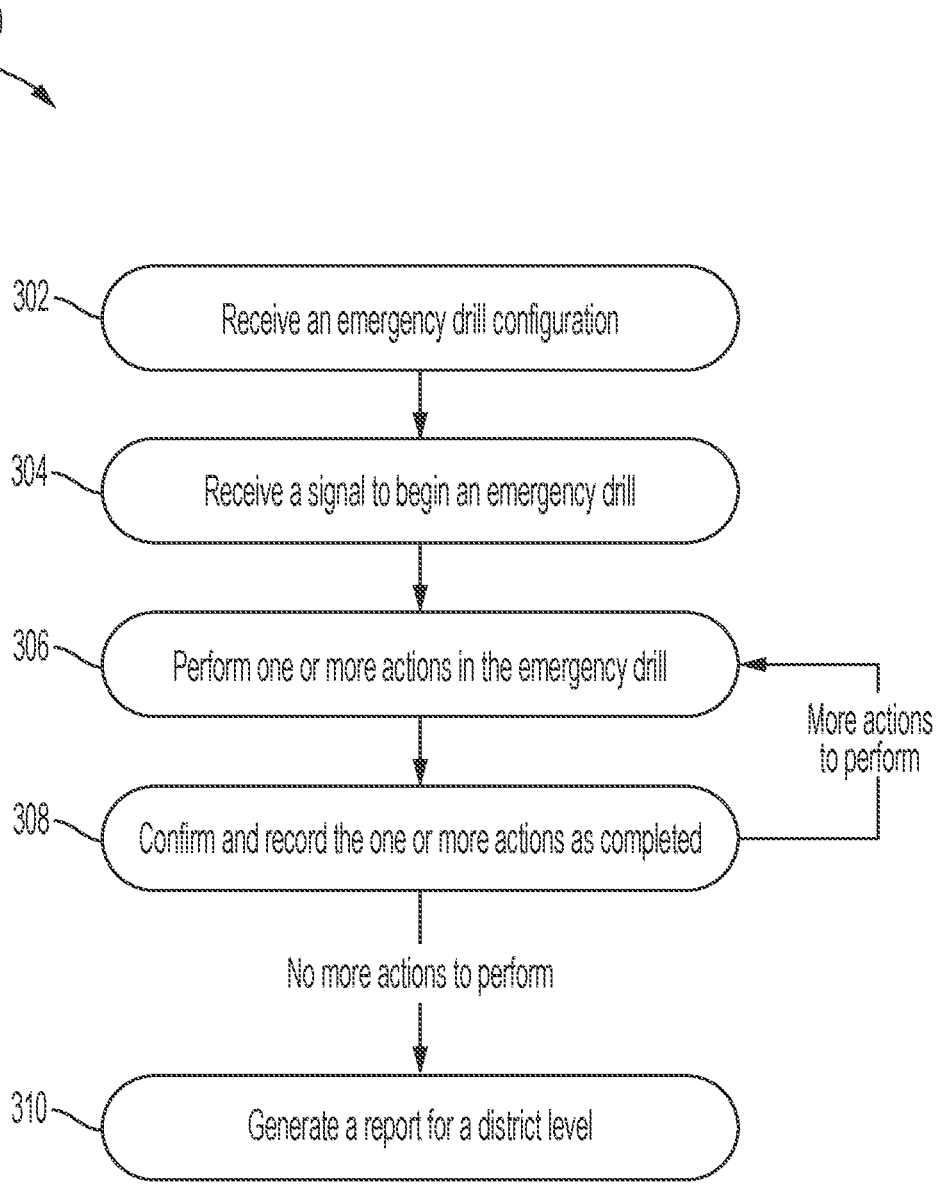
FIG. 3 is a process flow chart for performing an emergency drill, according to an exemplary embodiment.

In general, functionality described can be set up via the web based user interface from the user computer system 110 (see FIG. 1). FIG. 3 illustrates an emergency drill performance process 300. The process 300 provides exemplary steps performed by the campus controller 204 with the aid of the school communication system 200 (see FIG. 2). At step 302, the campus controller 204 receives an emergency drill configuration. The emergency drill configuration can include one or more actions to be performed during an emergency drill. The emergency drill configuration can include specific actions in an emergency action file that should be designated as drill steps. An action can be configured according to Table 2 with parameters as described in Table 2. In an embodiment, an emergency action file, e.g., one indicating actions in Table 1, is loaded by the campus controller 204, and the emergency drill configuration indicates which actions within the emergency action file are actions to be performed during a drill. The emergency action file and the emergency drill configuration can be received from the district level via the district network 106.

At step 304, the campus controller 204 receives a signal to begin an emergency drill. In an embodiment, the emergency drill is based on the emergency drill configuration received at step 302. The signal can be received from the district level via the district network 106. For example, the user computer system 110 can send the signal to the campus controller 204 to begin the emergency drill. In another embodiment, the administrative console 214 can send the signal to the campus controller 204 to initiate the emergency drill. In another embodiment, the campus controller 204 receives a signal from an aux IO module 220 to initiated the drill.

At 306, the campus controller 204 performs one or more actions in the emergency drill. In an example, if the action to be performed includes playing an audio file, the administrative console 214 instructs the campus controller 204, room controller 206, and/or the zone controller 212 to play the specific audio file via speakers. The action will include which locations the audio should be played. In an example, the campus controller 204 determines whether an action is included in the emergency drill by checking a drill flag of the action. The campus controller 204 can select which actions to perform based on the drill flag. The campus controller 204 can perform actions based on the order of each action, where actions with lower orders are completed before moving on to an action with a higher order.

At 308, the campus controller 204 confirms and records that the drill was initiated. Once the drill is initiated, the drill will run loop back to step 306 to perform additional steps of the drill until each of the steps is completed or terminated.

For example, during an evacuation drill, such as a fire drill, students at the campus performing the drill must evacuate the various classrooms. During the drill, a teacher or other room supervisor may actuate a call switch 210 once a room is completely evacuated. The campus controller 204 waits for the call switch 210 signals from one or more rooms that indicate that students have evacuated to designated areas based on the action to be performed. As the call switches 210 from the one or more rooms are pushed, the campus controller 204 can use a timeout signal to rank certain rooms within the campus that fail to meet a certain evacuation time limit. As this is happening, the process 300 loops from step 308 back to step 306 to perform each additional step in the drill.

Once each step of the drill is executed, or the drill is terminated, the process 300 proceeds to step 310. At step 310 the drill stops and a report is generated. In an embodiment, the report is generated only when specifically requested by a user using the user computer system 110 (see FIG. 1), and the report indicates whether the drill was successfully initiated. In other embodiments, the reports may provide a variety of relevant details about the drill execution that may be used subsequently to analyze the response to the drill and show compliance with various standards associated with emergency response drills.

Embodiments of the disclosure provide a system for initiating and guiding emergency drills such that organizations and facilities no longer need to manually initiate and guide the emergency drill. Potential avenues for human error are drastically reduced because the amount of human interaction time to coordinate emergency drills in a school is reduced. Furthermore, state regulatory agencies or other oversight agencies can readily access reports or documents for emergency drills. This provides an efficient way to audit emergency drill execution for purposes of compliance.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A district communication system, comprising:

a district server configured to manage a campus communication system located within a district location managed by the district server; and a district network configured to communicatively couple the campus communication system and the district server;

wherein the campus communication system comprises:

a network switch configured to integrate communication equipment associated with the campus communication system;

a campus controller; and room equipment for a plurality of rooms within a campus associated with the campus communication equipment, wherein, for each room of the plurality of rooms, the room equipment comprises a room controller, a speaker, one or more switches, and a status light indicator;

wherein the campus controller is configured to:

receive an emergency drill configuration of a user configurable list of actions in an ordered list of steps from the district server;

receive a signal to begin an emergency drill defined by the emergency drill configuration;

control the room equipment for each of the plurality of rooms to perform one or more actions defined in the emergency drill configuration;

receive, from the room equipment for each room of the plurality of rooms, data related to initiation and termination of the one or more actions in the emergency drill configuration;

record the data received from the room equipment for each room of the plurality of rooms as flags set in response to the one or more actions being performed when the emergency drill is performed; and send a report of the flags to the district server.

2. The system of claim 1, further comprising a user computer system communicatively coupled to the district server and configured to manage the emergency drill, wherein the district server is further configured to generate a report upon request from the user computer system, the report detailing the time of initiation of the emergency drill.

3. The system of claim 1, wherein the campus controller is further configured to manage an order of the one or more actions of the emergency drill by verifying completion of a lower order action of the emergency drill before performing a higher order action of the emergency drill.

4. The system of claim 1, wherein the communication equipment further comprises:

one or more status lights coupled to the network switch and controllable by the campus controller;

one or more speakers coupled to the network switch and controllable by the campus controller;

one or more auxiliary Input/Output (aux IO) modules coupled to the network switch and configured to actuate a relay and controllable by the campus controller; and one or more message boards coupled to the network switch and controllable by the campus controller.

5. The system of claim 4, wherein the one or more actions of the emergency drill comprise one or more of the following action types: play an audio message at the one or more speakers, actuate the relay, delay, send a preconfigured email message, control the one or more status lights, send a preconfigured phone audio message, and display a preconfigured text message on the one or more message boards.

6. The system of claim 1, wherein the emergency drill is a practice drill simulating events performed by the system during an actual emergency, and wherein the practice drill is not performed during an occurrence of the actual emergency.

7. The system of claim 6, wherein the emergency drill configuration excludes actions that would be performed by the system during the actual emergency.

8. The system of claim 7, wherein the excluded actions comprise:

notifying contacts of participants of the emergency drill of the actual emergency; and notifying law enforcement of the actual emergency.

9. The system of claim 1, wherein the report comprises a time when the emergency drill is performed and information regarding whether the emergency drill was successfully initiated.

10. The system of claim 9, wherein the report further comprises information regarding emergency drill execution indicative of compliance with one or more standards associated with the emergency drill.

11. The system of claim 9, wherein the report is generated only after completion of the emergency drill.

12. A method for performing an emergency drill at a campus communication system communicatively coupled to a district server via a district network, wherein the campus communication system comprises: a network switch configured to integrate communication equipment associated with the campus communication system; a campus controller; and room equipment for a plurality of rooms within a campus associated with the campus communication equipment, wherein, for each room of the plurality of rooms, the room equipment comprises a room controller, a speaker, one or more switches, and a status light indicator, wherein the campus communication system is managed by the district server to configure the campus controller to perform the method comprising:

receiving an emergency drill configuration of a user configurable list of actions in an ordered list of steps from a district server;

receiving a signal to begin an emergency drill, wherein the emergency drill comprises one or more actions to be performed by the campus communication system, and the one or more actions are defined in the emergency drill configuration;

controlling the room equipment for each of the plurality of rooms to perform the one or more actions defined in the emergency drill configuration;

receiving, from the room equipment for each room of the plurality of rooms, data related to the initiation and termination of the one or more actions in the emergency drill configuration;

recording the data received from the room equipment for each room of the plurality of rooms as flags set in response to the one or more actions being performed when the emergency drill is performed; and sending a report of the flags to the district server.

13. The method of claim 12, wherein the signal to begin the emergency drill is received from the district server.

14. The method of claim 12, wherein the one or more actions comprise playing an audio file, including time delays between actions, controlling status lights, and displaying a text message on a message board associated with the campus communication system.

15. The method of claim 12, further comprising receiving an indication at the campus controller that all people have been evacuated from a room.

16. The method of claim 15, further comprising relaying, by the campus controller, the indication that all people have been evacuated from the room to the district server, wherein the indication is based on a call switch signal from the one or more switches associated with the room.

17. A campus communication system communicatively associated with a campus and coupled to a district sever through a district network, the district server controls operation of the campus communication system via signaling through the district network, the campus communication system comprising:

a network switch configured to integrate communication equipment associated with the campus communication system;

a campus controller; and room equipment for a plurality of rooms within a campus associated with the campus communication equipment, wherein, for each room of the plurality of rooms, the room equipment comprises a room controller, a speaker, one or more switches, and a status light indicator;

wherein the campus controller is configured to:

receive an emergency drill configuration of a user configurable list of actions in an ordered list of steps from the district server;

receive a signal to begin an emergency drill defined by the emergency drill configuration;

control the room equipment for each of the plurality of rooms to perform one or more actions defined in the emergency drill configuration;

receive, from the room equipment for each room of the plurality of rooms, data related to the initiation and termination of the one or more actions in the emergency drill configuration; and record the data received from the room equipment for each room of the plurality of rooms as flags set in response to the one or more actions being performed when the emergency drill is performed; and send a report of the flags to the district server.

18. The campus communication system of claim 17, wherein the campus controller is further configured to manage an order of the one or more actions of the emergency drill by verifying completion of a lower order action of the emergency drill before performing a higher order action of the emergency drill.

19. The campus communication system of claim 17, wherein the communication equipment further comprises:

one or more status lights coupled to the network switch and controllable by the campus controller;

one or more speakers coupled to the network switch and controllable by the campus controller;

one or more auxiliary Input/Output (aux IO) modules coupled to the network switch and configured to actuate a relay and controllable by the campus controller; and one or more message boards coupled to the network switch and controllable by the campus controller.

20. The campus communication system of claim 19, wherein the one or more actions of the emergency drill comprise one or more of the following action types: play an audio message at the one or more speakers, actuate the relay, delay, send a preconfigured email message, control the one or more status lights, send a preconfigured phone audio message, and display a preconfigured text message on the one or more message boards.

* * * * *